US005701767A

United States Patent [19]

Cho

[11] Patent Number: 5,701,767

[45] Date of Patent: Dec. 30, 1997

[54] PULSATOR FOR A WASHING MACHINE

[75] Inventor: In-Su Cho, Kwangju, Rep. of Korea

[73] Assignee: Daewood Electronics Co. Ltd, Seoul, Rep. of Korea

[21] Appl. No.: 670,562

[22] Filed: Jun. 27, 1996

[30] Foreign Application Priority Data

Jun. 30, 1995 [KR] Rep. of Korea ..... 95-18773

[51] Int. Cl.[6] ..... D06F 17/10

[52] U.S. Cl. ..... 68/134

[58] Field of Search ..... 68/134

[56] References Cited

U.S. PATENT DOCUMENTS 1,810,047 6/1931 Hersh ..... 68/134

4,103,522 8/1978 Gibson ..... 68/134 X

*Primary Examiner*—Philip R. Coe

*Attorney, Agent, or Firm*—Beveridge, DeGrandi, Weilacher & Young, LLP

[57] ABSTRACT

Disclosed is a pulsator for a washing machine capable of preventing generation of a concentric waterflow such as a heart-type waterflow. The pulsator includes a base plate fixed to the shaft housing, a plurality of plate-shaped wings radially fixed to the upper surface of the base plate and for forming a concentric waterflow in the washing water, a plurality of cover plates fixed on the multi-stepped edges of the plurality of plate-shaped wings, a plurality of protrusions radially and in a certain length formed on the upper surface of each of the plurality of cover plates and for generating a waterflow of the washing water vertically oriented toward the top of the washing tub by being rotated according to the rotation of the base plat.

6 Claims, 6 Drawing Sheets

PULSATOR FOR A WASHING MACHINE

BACKGROUND OF THE INVENTION

1. Field of the Invention

The present invention relates to a washing machine, more particularly to a pulsator for a washing machine.

2. Prior Arts

In general, a washing machine for home use is a device which can easily remove dirt and other foreign materials contained in washing articles, using washing water, detergents and so on.

Such a washing machine for home use can be classified as a water whirlpool-style washing machine, a water stirring-style washing machine, or a drum-style washing machine by washing methods.

In this case, the water whirlpool-style washing machine is a washing machine which washes washing articles by friction among the washing articles. That is, if a pulsator mounted on the bottom of the washing tub is rotated, a heart-shaped waterflow is generated to cause contact of the washing articles with each other, so that the washing articles are washed.

The water stirring-style washing machine is a washing machine which washes washing articles due to the striking of the washing articles against the washing agitator and the wall of the washing tub. That is, if the washing agitator mounted on the center of the washing tub is regularly rotated, the stirring prominences formed on the outer surface of the washing agitator generates a waterflow so that the washing articles strike against the water agitator and the wall of the washing tub. The washing articles are washed by the striking of the washing articles against the water agitator and the wall of the washing tub.

On the other hand, the drum-style washing machine is a washing machine which washes washing articles by moving the washing articles up and down in a circular motion. The drum-style washing machine has a cylinder-type drum mounted in parallel with the washing tub. The cylinder-type drum includes a plurality of holes and a plurality of prominences. When the cylinder-type drum is rotated, the plurality of prominences move the washing articles up and the moved-up washing articles drop down due to the gravity of the earth. In the way mentioned above the dirt within the washing articles is washed clear. Of the washing machines mentioned above, the water whirlpool-style washing machine is generally used for home use.

The water whirlpool-style washing machine is explained below in detail, referring to FIGS. 1 and 2.

FIG. 1 is a schematic view of a conventional washing machine, and FIG. 2 is a schematic view of the pulsator of FIG. 1. As shown in FIG. 1, a motor 4, which generates a rotating force with an input of external electric power, is mounted on the outer bottom of the reservoir 1. A shaft housing 5 for transmitting the rotating force of motor 4 is connected to the motor 4 through pulleys 21 and a pulley belt 22. A rotating force of shaft housing 5 is transmitted to a pulsator 3 through a shaft 7 of shaft housing 5. Shaft 7 is protruded inside a washing tub 2 through the bottom of reservoir 1. On the upper portion of shaft 6 pulsator 3 is fixed. As shown in FIG. 2, pulsator 3 has a circular-shaped plate 8, and a plurality of wing prominences 6 radially formed on the upper surface of circular-shaped plate 8. In such a conventional washing machine, motor 4 is rotated with an input of electric power. The rotation of motor 4 is transmitted to shaft housing 5 to thereby rotate shaft 7. When shaft 7 is rotated, circular-shaped plate 8 of pulsator 3 is rotated. Accordingly, the plurality of wing prominences formed on circular-shaped plate 8 is rotated. The rotation of the plurality of wing prominences 6 rotates the washing water and the washing articles. That is, the rotation of pulsator 3 generates a centrifugal force of the washing water, and the centrifugal force moves the outer periphery portion of the washing water upwards while moving the inner portion of the washing water downwards. Therefore, a heart-type waterflow is formed in the washing water. Such a heart-type waterflow which is a concentric waterflow, causes the washing articles to be gathered in the center thereof and to make contact with each other so as to remove the dirt of the washing articles.

In the washing of washing articles by the heart-type waterflow, the washing articles in the center portion of the heart-type waterflow become tangled with each other to thereby deteriorate the effectiveness of the washing. Since the washing articles move in accordance with the heart-type waterflow, the washing articles in the center portion of the heart-type waterflow are not sufficiently washed.

SUMMARY OF THE INVENTION

Accordingly, it is an object of the present invention to provide a pulsator for a washing machine capable of preventing generation of a concentric waterflow such as a heart-type waterflow.

In order to achieve the object, a pulsator for a washing machine according to an embodiment of the present invention comprises a base plate, a plurality of plate-shaped wings, a plurality of cover plates and a plurality of protrusions. The base plate is fixed to a shaft housing to be rotated according to a rotation of the shaft housing. The plurality of plate-shaped wings is radially and vertically fixed to the upper surface of the base plate so as to be rotated according to the rotation of the plurality of plate-shaped wings. The rotation of the plurality of plate-shaped wings forms a concentric waterflow in washing water. Each of the plurality of plate-shaped wings has a multi-stepped edge. The plurality of cover plates is fixed on the multi-stepped edges of the plurality of plate-shaped wings. Each of the plurality of cover plates is a disc-shaped plate having a hole in the center portion. The plurality of protrusions is radially and in a certain length formed on the upper surface of each of the plurality of cover plates. The plurality of protrusions is rotated according to the rotation of the base plate to generate a waterflow of the washing water vertically oriented toward the top of the washing tub.

Therefore, using the pulsator for a washing machine according to the present invention can generate an effect that prevent the tangling of washing articles by generating a vertically oriented waterflow to inhibit the generation of a concentric waterflow in the washing water, as well as generates another effect that performs washing of the washing articles sufficiently by floating the washing articles fully in the washing tub.

BRIEF DESCRIPTION OF THE DRAWINGS

The above object, and other features and advantages of the present invention will be apparent by describing the preferred embodiment of the present invention hereinafter with reference to the accompanying drawings in which.

DESCRIPTION OF THE PREFERRED EMBODIMENT

The preferred embodiment of the present invention will be described below in detail with reference to the accompanying drawings.

Figure 1:
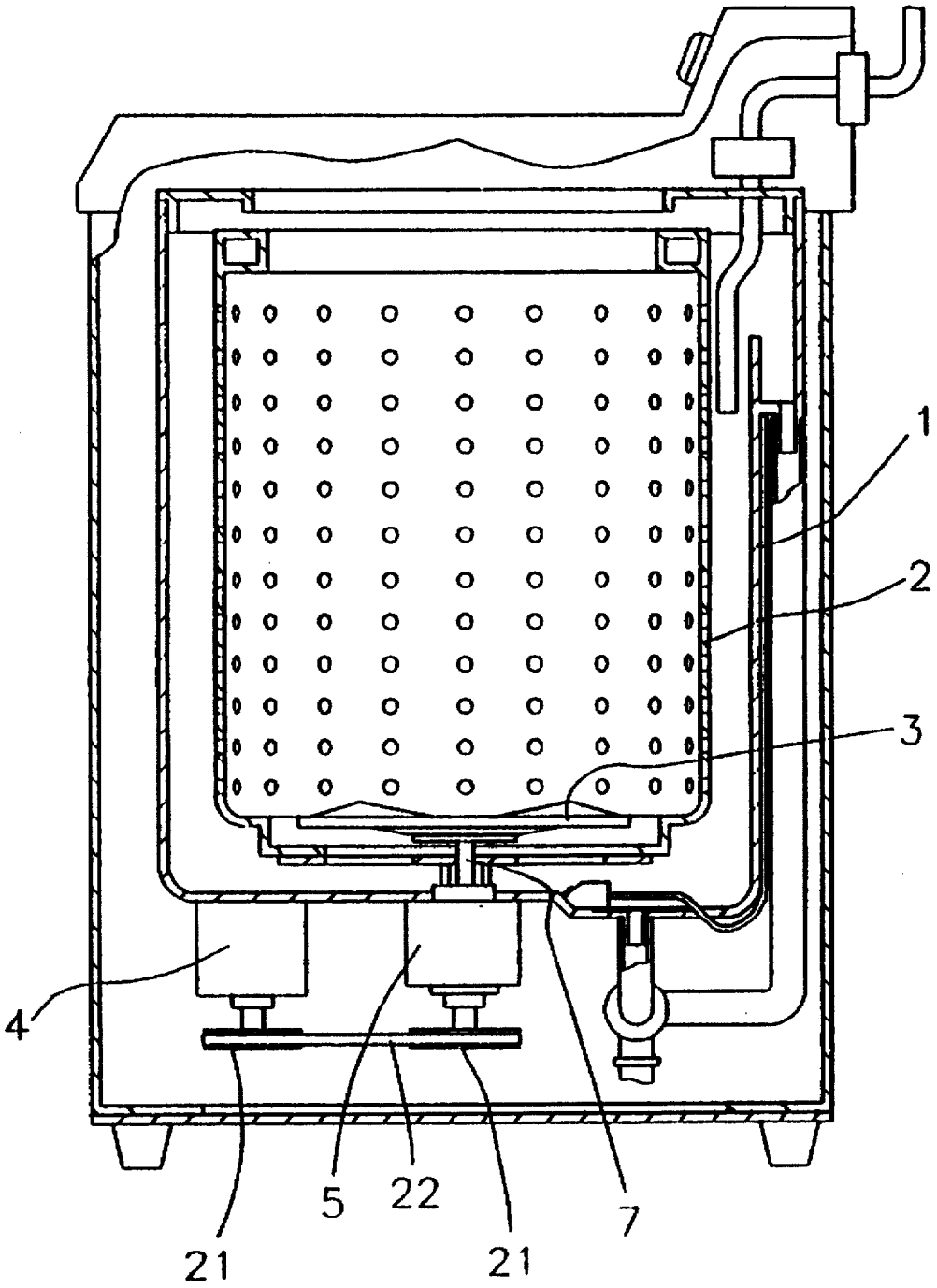
FIG. 1 PRIOR ART
FIG. 1 is a schematic view for a conventional washing machine.
Figure 2:
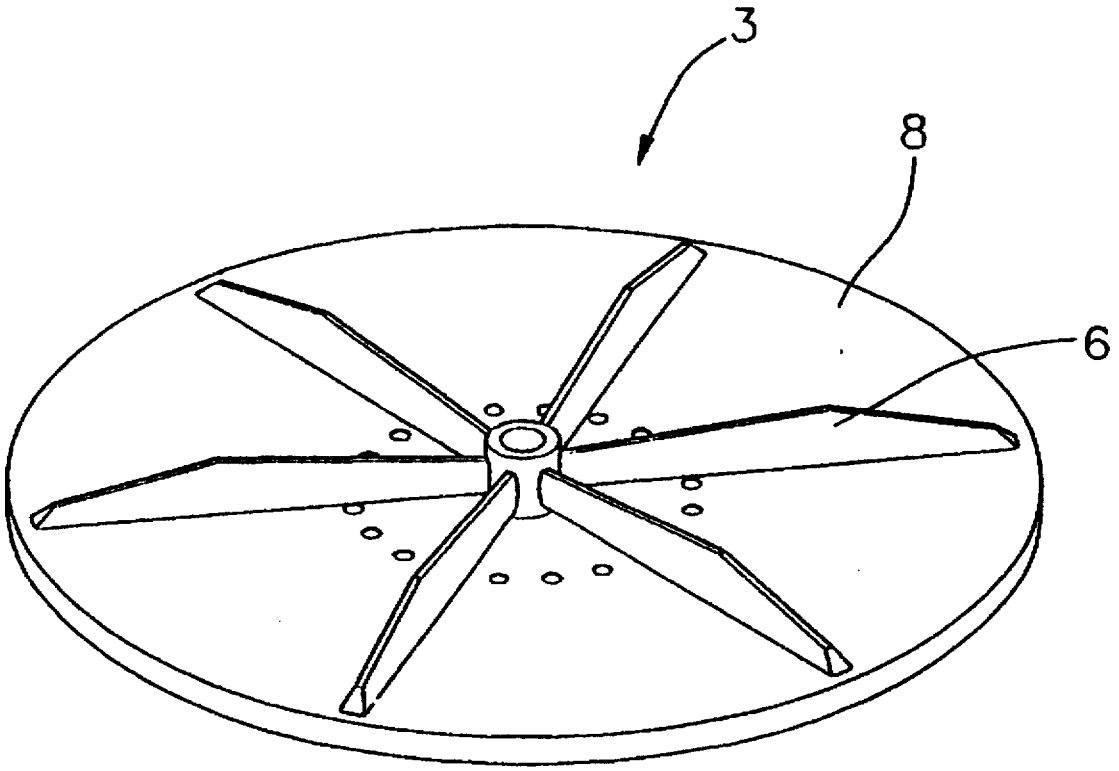
FIG. 2 PRIOR ART
FIG. 2 is a schematic view for the pulsator of FIG. 1.
Figure 3:
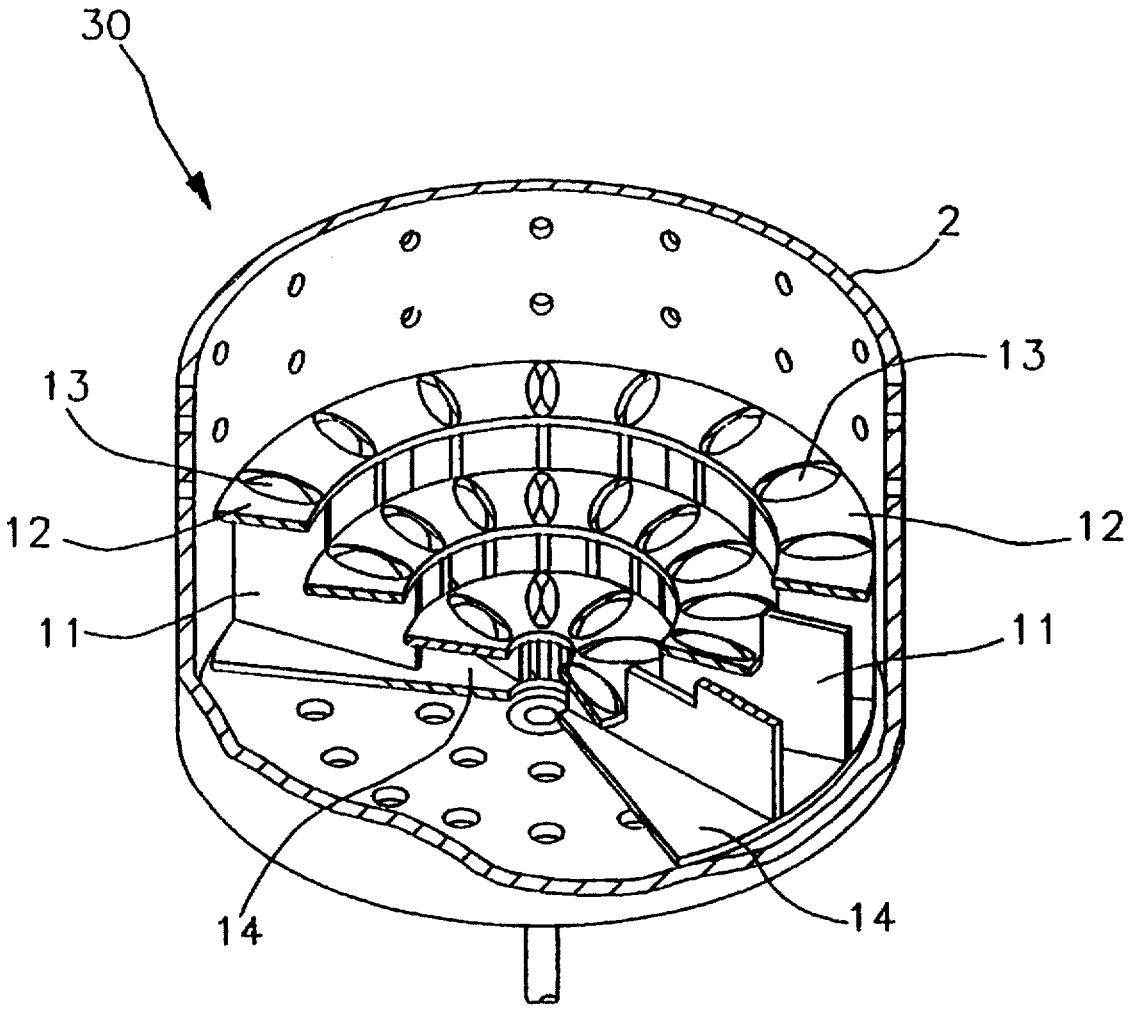
FIG. 3 is a detailed view for showing a pulsator for a washing machine according to an embodiment of the present invention.
Figure 4:
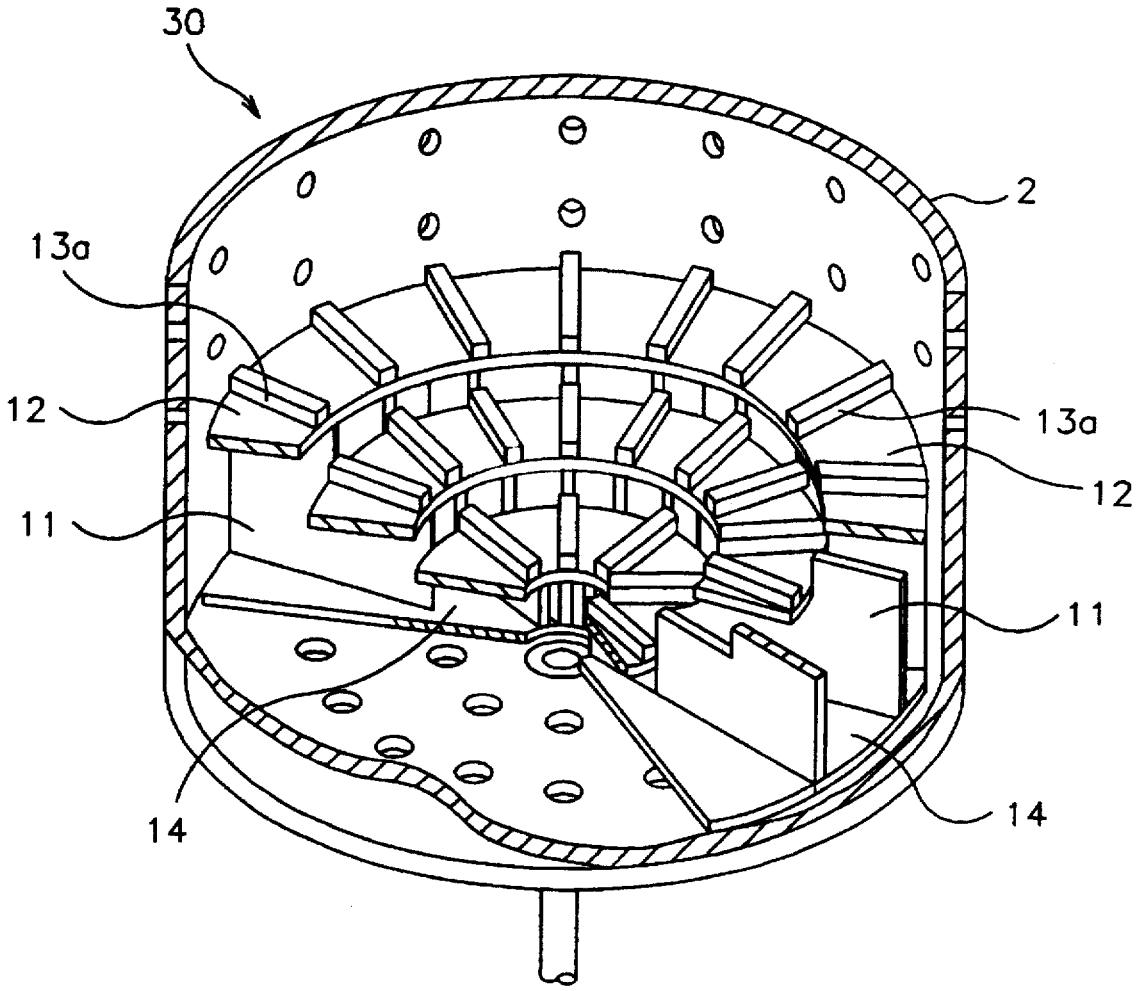
FIGS. 4, 5, and 6 are views for showing pulsators for a washing machine according to other embodiments of the present invention.
Figure 5:
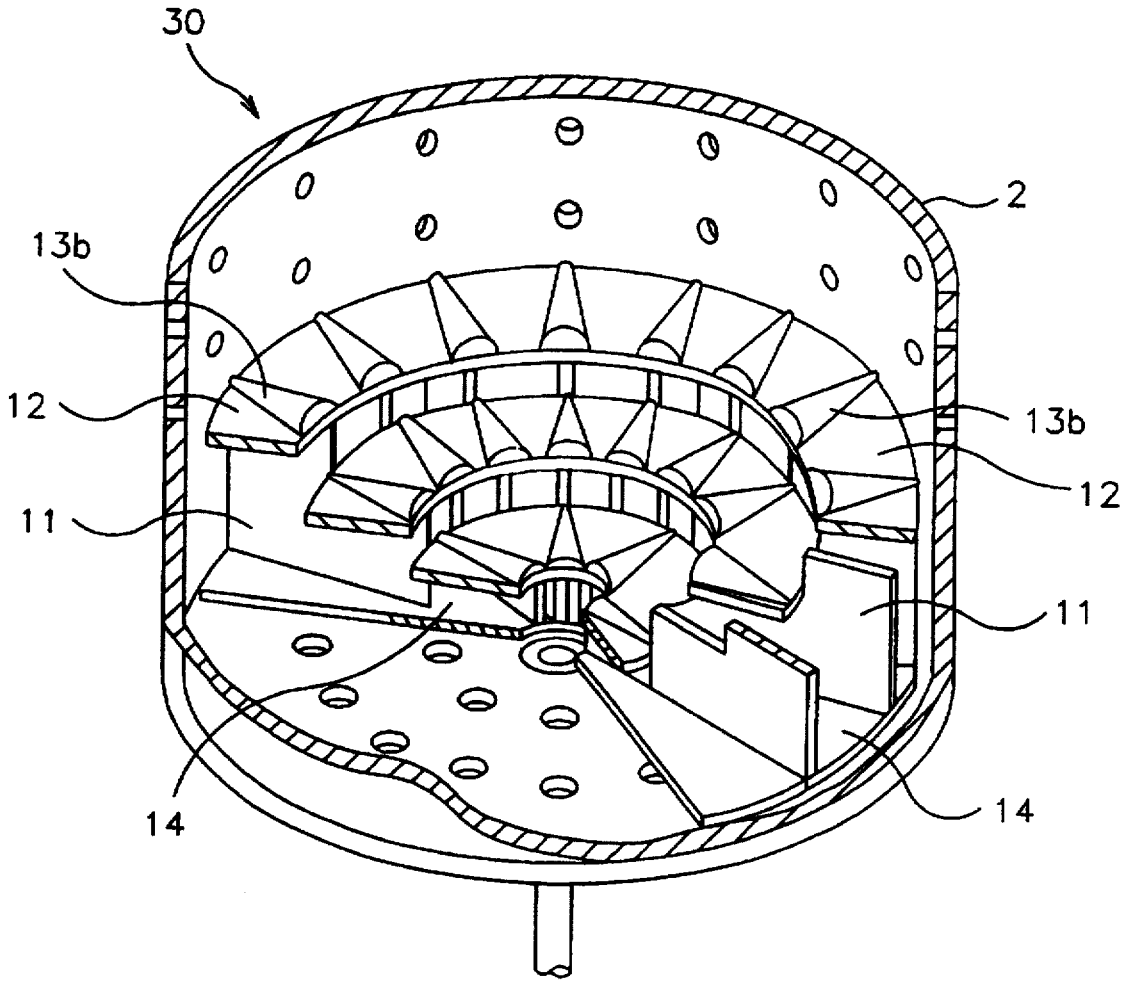
Figure 6:
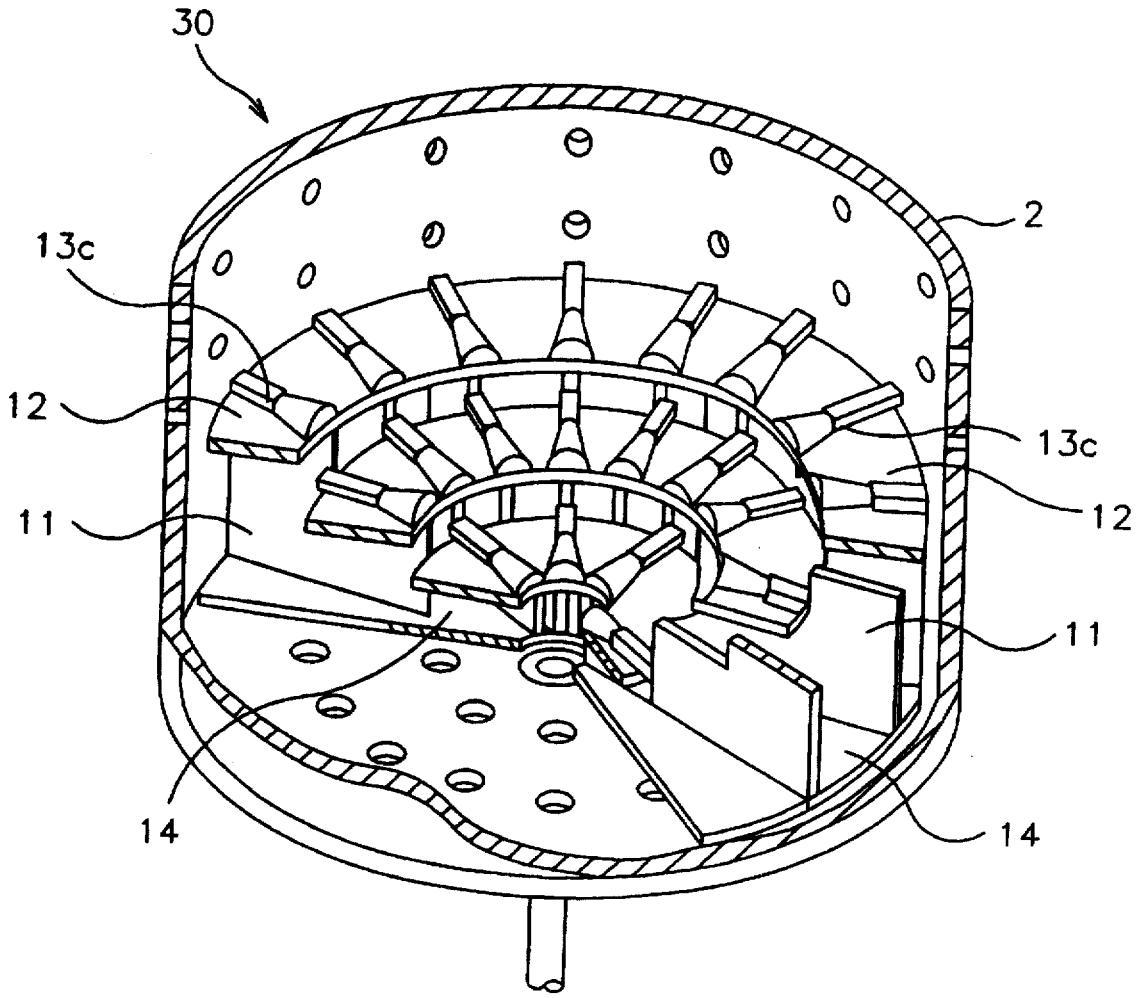

FIG. 1 is a schematic view for a conventional washing machine, and FIG. 3 is a detailed view for showing a pulsator for a washing machine according to an embodiment of the present invention. As shown in FIGS. 1 and 3, a pulsator 30 for a washing machine according to an embodiment of the present invention comprises a base plate 14, a plurality of plate-shaped wings 11, a plurality of cover plates 12 and a plurality of protrusions 13. Base plate 14 is fixed to the shaft of a shaft housing (not shown) and mounted in a washing tub 2. Base plate 14 is rotated according to a rotation of the shaft. Base plate 14 is a thin plate having a disc shape. The plurality of plate-shaped wings 11 is radially and vertically fixed to the upper surface of base plate 14. The plurality of plate-shaped wings 11 is rotated according to the rotation of base plate 14. The rotation of the plurality of plate-shaped wings 11 forms a concentric waterflow in washing water. Each of the plurality of plate-shaped wings 11 has a multi-stepped edge so as to attain a height from base plate 14 progressively from the center of base plate 14 to the outer periphery of base plate 14. The plurality of plate-shaped wings 11 enhances the strength of base plate 14. Therefore, base plate 14 may be a disc-shaped thin plate. The plurality of cover plates 12 is fixed on the multi-stepped edges of the plurality of plate-shaped wings 11. Each of the plurality of cover plates 12 is a disc-shaped plate having a hole in the center portion like a ring shape. Further, each of the plurality of cover plates 12 has a concentric relationship with washing tub 2 and covers only one step of the multi-steps. The plurality of protrusions 13 is radially and in a certain length formed on the upper surface of each of the plurality of cover plates 12. The plurality of protrusions 13 is rotated according to the rotation of base plate 14 to generate a waterflow of washing water vertically oriented toward the top of washing tub 2. Each of the plurality of protrusions 13 may be a bar shape, identified by reference numeral **13*a* as shown in FIG. 4 a conical shape identified by reference numeral 13*b* as shown in FIG. 5, or a combination of the bar and the conical shapes identified by reference numeral 13*c* as shown in FIG. 6**.

Operations of the pulsator according to an embodiment of the present invention will be described below.

For washing of washing articles, washing water fills washing tub 2. As shown in FIGS. 1 and 3, a rotating force of motor 4 rotates pulsator 30 in washing tub 2 through shaft housing 5. With a rotation of pulsator 30, the plurality of plate-shaped wings 11, which is fixed to base plate 14, is rotated. The rotation of the plurality of plate-shaped wings 11 generates a waterflow in a peripheral direction, which is a concentric waterflow in the washing water in washing tub 2. The rotation of the plurality of plate-shaped wings 11 rotates the plurality of cover plates 12 which covers the multi-steps of the plurality of plate-shaped wings 11, and the rotation of the plurality of cover plates 12 rotates the plurality of protrusions 13 formed on the upper surfaces of the plurality of cover plates 12. The rotation of the plurality of protrusions 13 generates a vertically oriented waterflow, that is, a waterflow toward the top of washing tub 2, in the washing water. The vertically oriented waterflow inhibits the concentric waterflow generated by the plurality of plate-shaped wings 11. Further, the vertically oriented waterflow causes the washing articles to fully float up, and the inhibited concentric waterflow performs a sufficient washing of the washing articles since the tangling of the washing articles is prevented.

As mentioned above, using the pulsator for a washing machine according to the present invention can generate an effect that prevents the tangling of washing articles by generating a vertically oriented waterflow to inhibit the generation of a concentric waterflow in the washing water, as well as generates another effect that performs washing of the washing articles sufficiently by floating the washing articles fully in the washing tub.

While the present invention has been particularly shown and described with reference to the particular embodiment thereof, it will be understood by those skilled in the art that various changes in form and details may be effected therein without departing from the spirit and scope of the invention as defined by the appended claims.

I claim:

1. A pulsator for a washing machine mounted in a washing tub and for generating a waterflow in washing water in the washing tub by a rotation according to a rotation of a shaft housing, comprising:

a base plate fixed to the shaft housing to be rotated according to a rotation of the shaft housing;

a plurality of plate-shaped wings radially fixed to the upper surface of the base plate so as to be rotated according to the rotation of the base plate, and for forming a concentric waterflow in the washing water, each of the plurality of plate-shaped wings having a multi-stepped edge;

a plurality of cover plates fixed on the multi-stepped edges of the plurality of plate-shaped wings, each being a disc-shaped plate having a hole in the center portion;

a plurality of protrusions radially and in a certain length formed on the upper surface of each of the plurality of cover plates, and for generating a waterflow of the washing water vertically oriented toward the top of the washing tub by being rotated according to the rotation of the base plate.

2. The pulsator as claimed in claim 1, wherein the base plate is a plate having a disc shape.

3. The pulsator as claimed in claim 1, wherein a height of each of the plurality of plate-shaped wings is progressively increased from the center of the base plate to the outer periphery of the base plate with respect to the base plate.

4. The pulsator as claimed in claim 1, wherein each of the plurality of protrusions is formed in a rectangular bar shape.

5. The pulsator as claimed in claim 1, wherein each of the plurality of protrusions is formed in a conical shape.

6. The pulsator as claimed in claim 1, wherein each of the plurality of protrusions is formed in a combination of the rectangular bar and the conical shapes.

* * * * *